US005356203A

United States Patent [19]

Levasseur et al.

[11] Patent Number: 5,356,203

[45] Date of Patent: Oct. 18, 1994

[54] ADJUSTABLE FOOTREST

[76] Inventors: Leon E. Levasseur; Leon J. Levasseur, both of 50 Whitney St., Holliston, Mass. 01746

[21] Appl. No.: 77,595

[22] Filed: Jun. 17, 1993

[51] Int. Cl.[5] ..... A47C 16/02

[52] U.S. Cl. ..... 297/423.45; 108/8; 248/423; 297/423.46

[58] Field of Search ..... 297/258, 261, 325, 329, 297/423.42, 423.45, 423.46; 108/1, 8; 248/125, 423

[56] References Cited

U.S. PATENT DOCUMENTS

| | | | |
|---|---|---|---|
| 2,083,605 | 6/1937 | Jertberg | 297/423.45 X |
| 3,606,458 | 9/1971 | Attinger | 297/423.45 |
| 3,653,715 | 4/1972 | Drabert et al. | 297/423.46 X |
| 4,228,745 | 10/1980 | Gale | 108/116 |

FOREIGN PATENT DOCUMENTS

| | | | |
|---|---|---|---|
| 64675 | 8/1946 | Denmark | 108/1 |
| 1079004 | 8/1967 | United Kingdom | 297/423.45 |

OTHER PUBLICATIONS

Back Saver Catalog (3 pages) 1993.

*Primary Examiner*—Peter R. Brown

*Attorney, Agent, or Firm*—John E. Toupal; Harold G. Jarcho

[57] ABSTRACT

A footrest including a frame having a base portion for placement on a supporting surface and a standard portion projecting upwardly from the base portion; the standard portion having a pair of substantially parallel, horizontally spaced apart upright members; a support having opposite ends slidably supported by the upright members and adapted for vertical movement thereon; and a securing mechanism operable to prevent vertical movement of the support. The slidable support can be easily adjusted to a desired height.

9 Claims, 5 Drawing Sheets

ADJUSTABLE FOOTREST

BACKGROUND OF THE INVENTION

This invention relates to a footrest and, more particularly, to a vertically adjustable footrest.

Persons sitting in chairs at desks, work tables and the like often use footrests for leg support. Such footrests have been developed in a wide variety of forms. A deficiency of most prior footrests resides in their use of a foot support surface that cannot be vertically adjusted to a supporting frame so as to suit the preference of the user. An improved footrest with a vertically adjustable foot support surface is disclosed in U.S. Pat. No. 3,132,835. However, that footrest also suffers from various disadvantages including high cost, limited adjustability and lack of flexibility.

The object of this invention, therefore, is to provide an improved footrest which is vertically adjustable.

SUMMARY OF THE INVENTION

The invention is a footrest including a frame having a base portion for placement on a supporting surface and a standard portion projecting upwardly from the base portion; the standard portion having a pair of substantially parallel, horizontally spaced apart upright members; a support having opposite ends slidably supported by the upright members and adapted for vertical movement thereon; and a securing mechanism operable to prevent vertical movement of the support. The slidable support can be easily adjusted to a desired height.

According to certain features of the invention, the upright members have free ends, and opposite ends of the support each having a hole receiving one of the upright members. Desired adjustability is facilitated by this structure.

According to other features of the invention, each of the opposite ends defines a threaded aperture transverse to and communicating with the hole, and the securing mechanism includes a set screw received by each of the threaded apertures. Establishing a desired height for the support is easily accomplished with this mechanism.

According to yet other features of the invention, the support includes a rigid inner tube defining the holes and the threaded apertures, and an outer tube formed from a resilient material. User comfort is enhanced by the provision of a resilient outer tube.

According to still other features of the invention, the standard portion further includes a pair of substantially parallel, horizontally spaced apart struts having upper ends joined to upper ends of the upright members by upwardly curved members, the base portion includes an elongated member for placement on a support surface and having opposite ends joined to bottom ends of the struts; each upright member slopes upwardly toward a joined strut, and each strut slopes upwardly toward a joined upright member. Operational flexibility is enhanced by the curved members and struts which accommodate sliding movement of the support.

According to an additional feature of the invention, the base further includes free ends of the upright members, and the frame is a continuous length of tubing. Manufacturing costs are reduced by these features.

According to another feature of the invention, the footrest includes a cross member having opposite ends slidably supported by the struts and adapted for vertical movement thereon. The provision of a vertically adjustable cross member further enhances operational flexibility.

According to one embodiment of the invention, the support defines a first foot support surface of a given shape, and the cross member defines a second foot support surface of a substantially different shape. The support surfaces of different shape allow a user to select a desired function.

According to another embodiment of the invention, the cross member is identical to the support. Provision of identical supports and cross members permits selection of a desired combined foot support surface.

According to still other features of the invention, the elongated base member has a serrated surface portion, and the footrest includes a heater operable to heat the support. Footrest stability is enhanced by the serrated surface and the heater adds to user comfort.

In another featured embodiment of the invention, a support assembly is straddled by pairs of upright members and struts and has opposite edges slidably attached thereto by rings rotationally received by the opposite edges and selectively spaced apart thereon. The rotatable rings facilitate selective tilting of the support assembly and the selective ring spacing permits height adjustment of the support assembly.

BRIEF DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENTS

Figure 1:
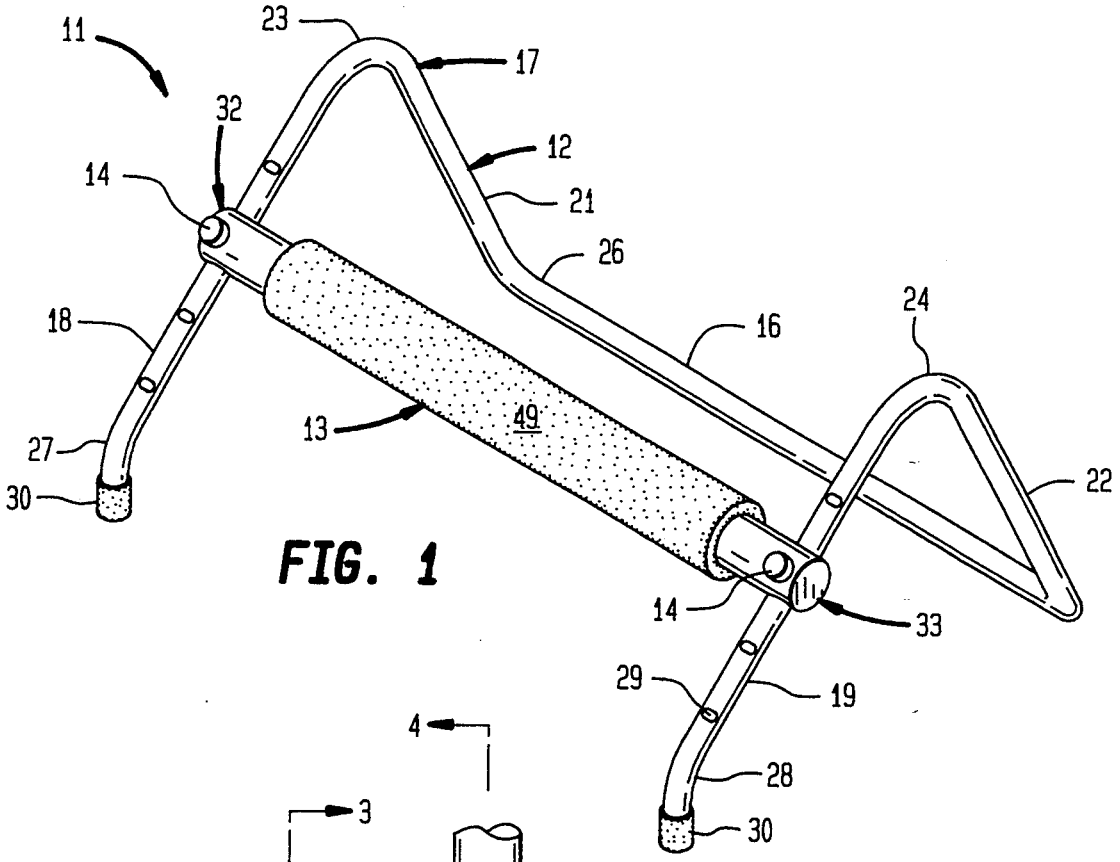
FIG. 1 is a perspective view of a footrest according to the invention.

A footrest 11 in accordance with the invention is illustrated in FIGS. 1–4. Included in the footrest 11 is a frame 12 formed with a continuous piece of tubing, a support assembly 13 supported by the frame 12 and a pair of set screws 14 for securing the support assembly 13 to the frame 12. The frame 12 includes a base portion 16 and a standard portion 17 projecting upwardly therefrom. Formed by the standard portion 17 are a pair of parallel, horizontally spaced apart upright members 18, 19; a pair of parallel, horizontally spaced apart struts 21, 22; and a pair of upwardly curved members 23, 24 joining respectively, the upper ends of the upright member 18 and strut 21 and the upright member 19 and the strut 22.

As shown in FIG. 1, the upright members 18, 19 slope upwardly toward, respectively, the joined struts 21, 22; and the struts 21, 22 slope upwardly toward, respectively, the joined upright members 18 and 19. Also formed by the frame 12 is an elongated member 26 extending between the bottom ends of the struts 21, 22 and forming with free bottom ends 27, 28 of the upright members 18, 19; the base portion 16 which is adapted for placement on a suitable supporting surface. The free ends 27, 28 are covered by caps 30. Stamped into each of the upright members 18, 19 are a plurality of vertically spaced apart recesses 29.

The support assembly 13 includes an inner tube 31, caps 32, 33 covering identical opposite ends 35 of the inner tube 31, and an outer tube 38 covering that length portion of the inner tube 31 between the upright members 18, 19. Slidably receiving the opposite ends 31, 32 of the support assembly 13 is the tubular standard portion 17. The support assembly 13 is vertically movable along either the upright members 18, 19 or the struts 21, 22 after passing over the curved members 23, 24.

Figure 2:
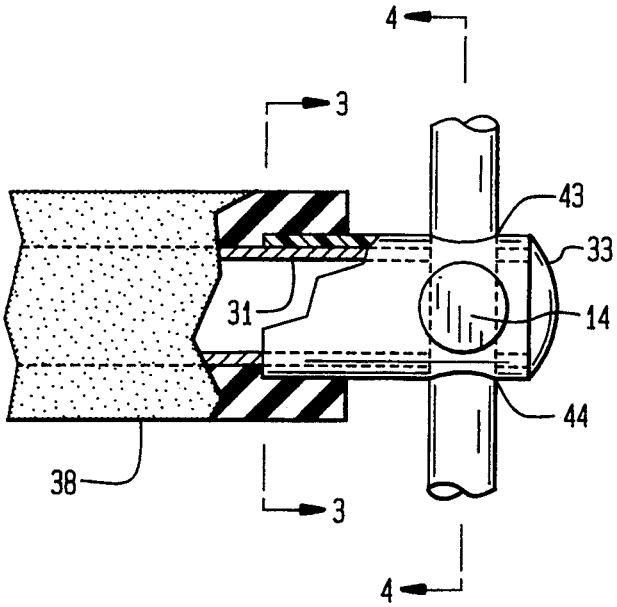
FIG. 2 is a detailed, partially cut-away portion of the footrest shown in FIG. 1.
Figure 3:
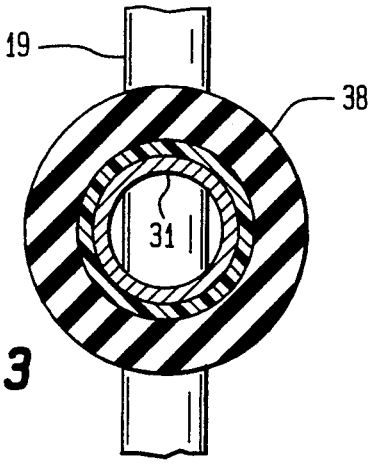
FIG. 3 is a cross-sectional view taken along lines 3—3 of FIG. 2.
Figure 4:
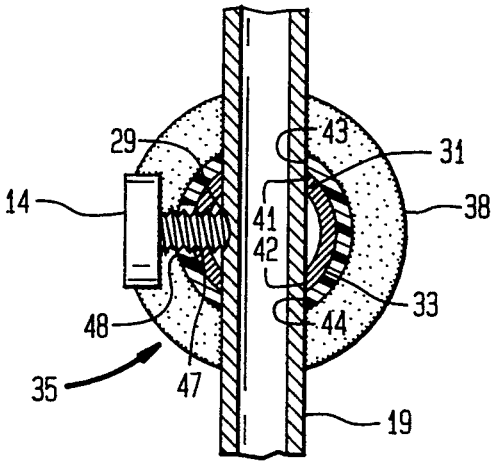
FIG. 4 is a cross-sectional view taken along lines 4—4 of FIG. 2.

FIGS. 2 and 4 show one of the identical opposite ends 35 of the support assembly 13. The inner tube 31 preferably is formed from a suitable rigid material such as metal, the outer tube 38 is preferably formed of a suitable resilient material such as foamed plastic and the caps 32, 33 preferably are formed of a plastic suitable for injection molding. Slidably receiving the upright member 19 is a composite hole created by aligned holes 41, 42 formed in the inner tube 31 and aligned with openings 43, 44 in the cap 33. Also formed in the end 35 of the inner tube 31 is a threaded aperture 47 extending perpendicular to the aligned holes 41, 42 and accommodating one of the set screws 14. Aligned with the threaded aperture 47 is an opening 48 in the cap 33.

Prior to use of the footrest 11, the support assembly 13 can be moved into any selected horizontal position along the upright members 18, 19; the curved members 23, 24 or the struts 21, 22 after loosening of the set screws 14. Once a desired position is obtained, the set screws 14 are tightened against that portion of the tubular standard 17 within the opposite ends 35 of the inner tube 31 as shown in FIG. 4. Frictional forces between the engaged set screws 14 and the standard 17 maintain the support assembly 13 in the selected position. Securement of the support assembly 13 is enhanced by tightening of the set screws 14 into a pair of thee horizontally aligned, graduated recesses 29 if one of the positions defined thereby is desired. However, positions intermediate the graduated recesses 29 can be established also if desired.

Figure 5:
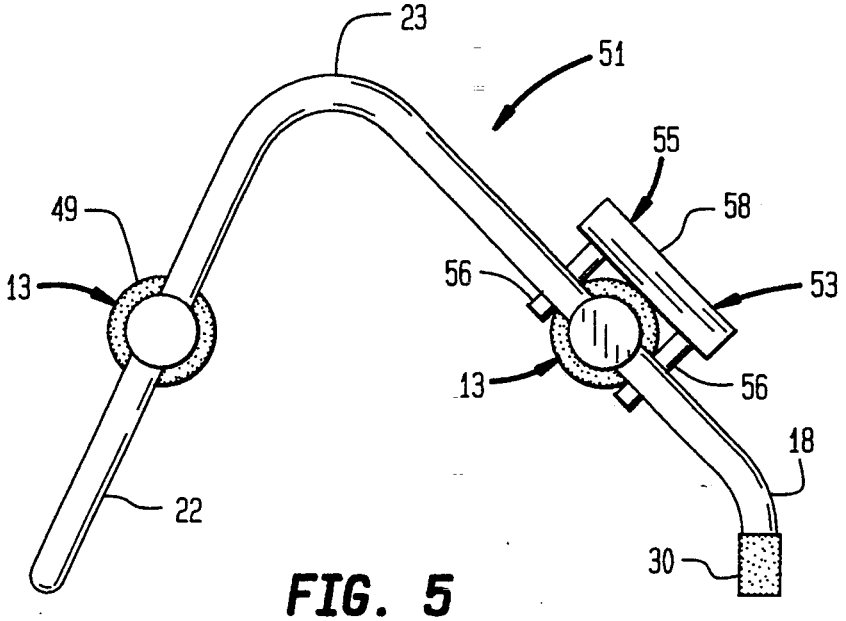
FIG. 5 is a side view of another footrest embodiment of the invention.
Figure 6:
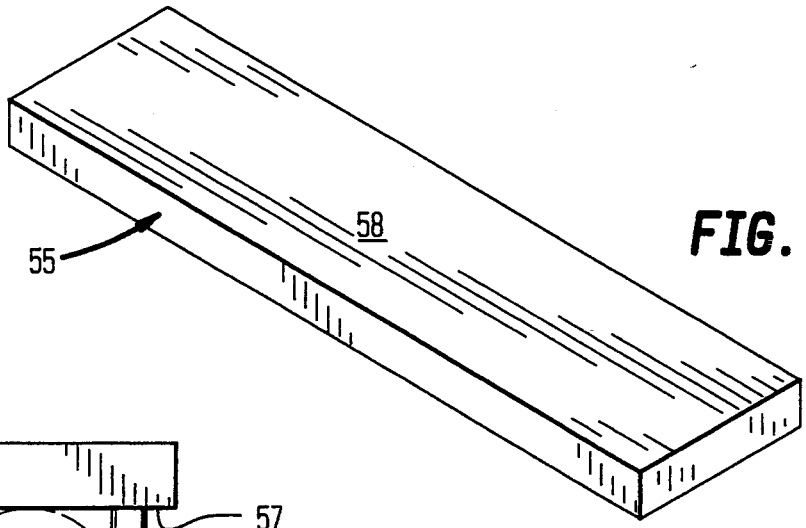
FIG. 6 is a perspective view of a component used in the footrest shown in FIG. 5.
Figure 7:
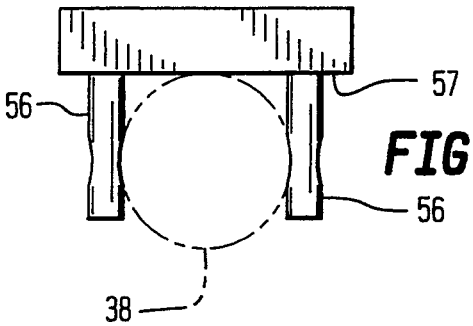
FIG. 7 is a side view of the component shown in FIG. 6.
Figure 8:
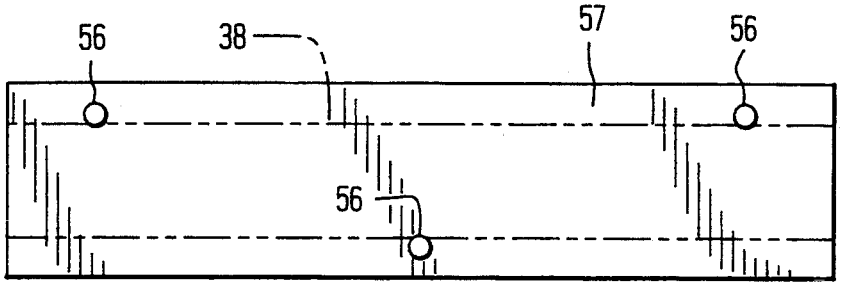
FIG. 8 is a bottom view of the component shown in FIG. 6.
Figure 9:
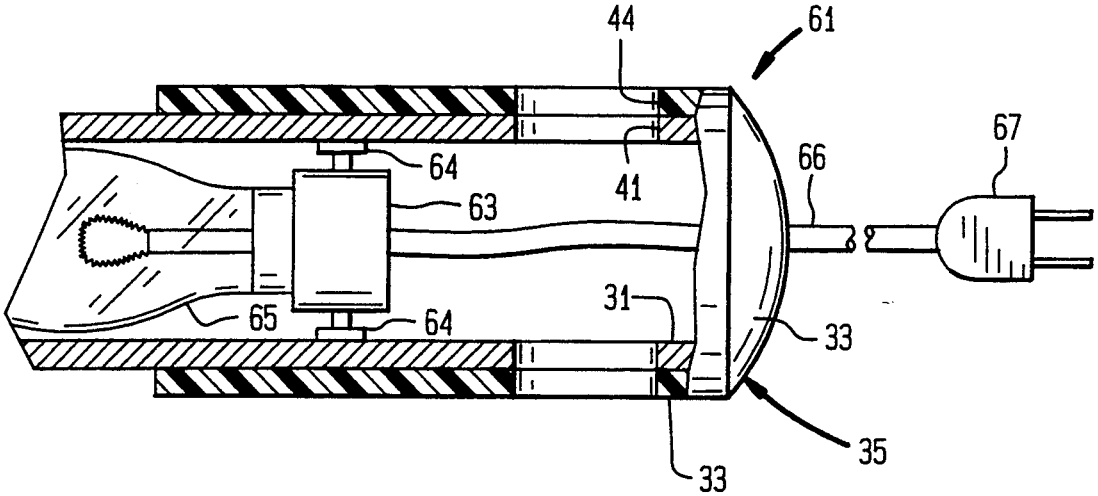
FIG. 9 is a partially cut-away plan view of a modified component for use in the footrests shown in FIGS. 1 and 5.

Illustrated in FIG. 5 is another footrest embodiment 51 for which components identical to those of the embodiment 11 have been given the same reference numerals. A support assembly 13 is disposed in a desired vertical position on the frame 12 between the struts 21, 22. The outer surface of the support assembly 13 of the footrest embodiment 51 provides a cushioned, cylindrically shaped foot support surface 49 in the same manner as the footrest embodiment 11 of FIG. 1. However, a cross member attachment 53 provides the footrest embodiment 51 with greater operational flexibility. The cross member 53 is removably attached to a support assembly 13 disposed in a desired position on the frame 12 between the upright members 18, 19. As shown in FIGS. 6–8, the cross member 53 is formed by an elongated, preferably wooden plate 55 and a plurality of connector dowels 56 projecting out of an inner surface 57 thereof. A planar outer surface 58 of the plate 55 provides a planar foot support surface. Thus, the footrest embodiment 51 can be arranged to provide either a foot support surface 49 of a given cylindrical shape formed by the support assembly 13 or a foot support surface 58 of a different planar shape formed by the cross member attachment 53. To assemble the cross member 53, the longitudinally and transversely spaced apart connector dowels 56 are pushed over the support assembly 13 as shown in FIGS. 7 and 8 and causing compression of the outer tube 38 and resultant secure retention of the plate 55. Illustrated in FIG. 9 is another support assembly embodiment 61 for use with either of the footrest embodiments 11 or 51. The support assembly embodiment 61 is identical to the support assembly 13 shown in FIGS. 2–4 except for the mounting within the end 35 of the inner tube 31 of a heater assembly 62. Included in the heater assembly 62 is a socket 63 supported by brackets 64, a light bulb 65 retained by the socket 63 and a power cord 66 having ends connected to the socket 63 and a plug 67. During use of the support assembly embodiment 61, the plug 67 can be inserted into a conventional voltage outlet to energize the bulb 65. The heat generated by the bulb 65 will elevate the temperature of the inner tube 31 providing a user with an internally heated foot support surface 49.

Figure 10:
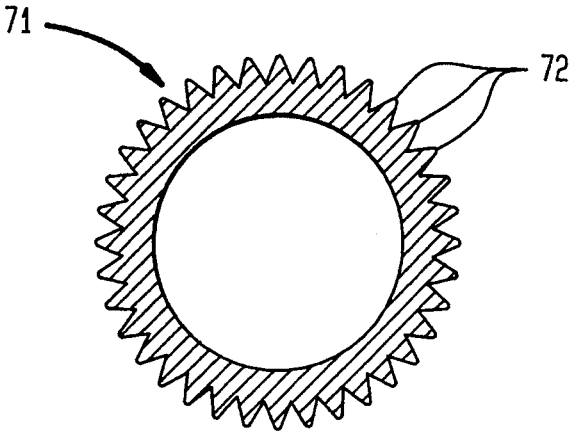
FIG. 10 is a cross-sectional view showing a modified component for use in the footrests shown in FIGS. 1 and 5.

Illustrated in FIG. 10 is a modified tube 71 for forming the frame 12 of the footrest embodiments 11 and 51. The tube 71 has an outer surface defining serrations 72. Preferably, the tube 71 is an extrusion formed with a die that creates the serrations 72. Because of the serrations 72, an increased level of friction is established between a supporting surface and the elongated base portion member 26 of the frame 12. Accordingly, inadvertent movement of the frame 12 in response to the application of the force against the support assembly 13 is prevented.

Figure 11:
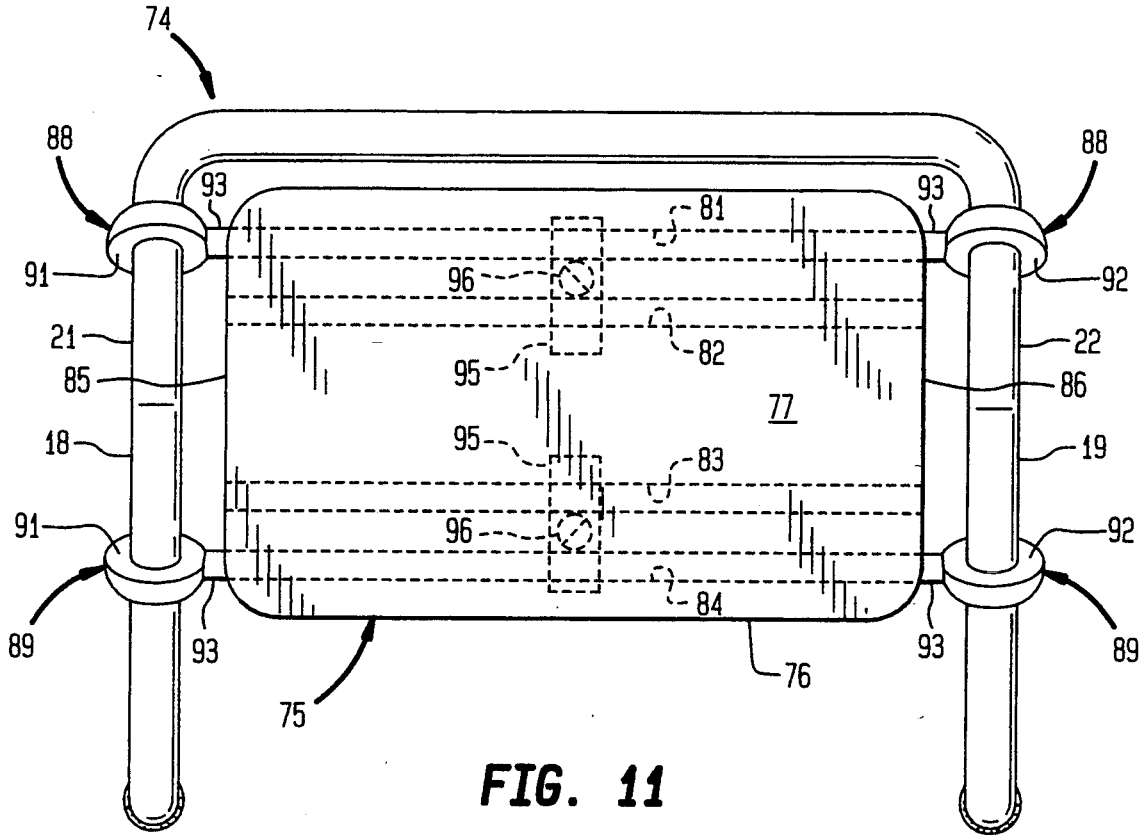
FIG. 11 is a plan view of another footrest embodiment of the invention.
Figure 12:
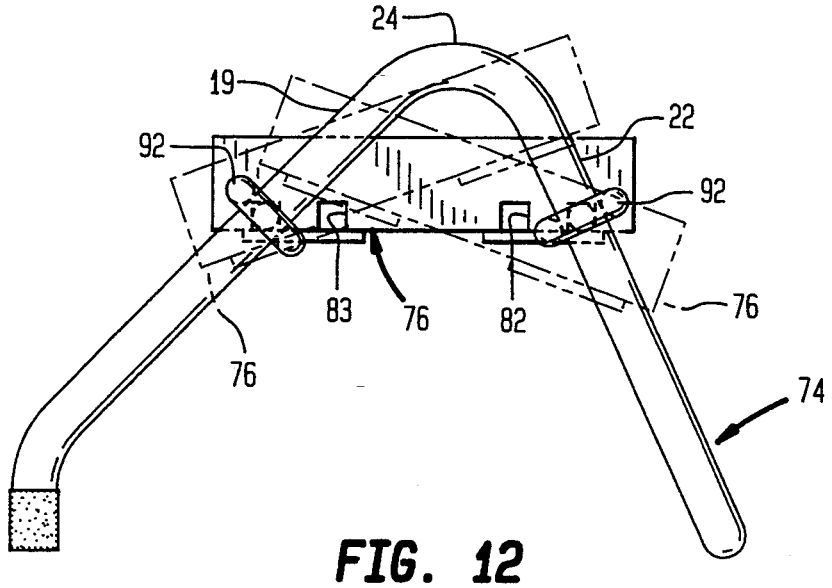
FIG. 12 is a side view of the embodiment shown in FIG. 11.
Figure 13:
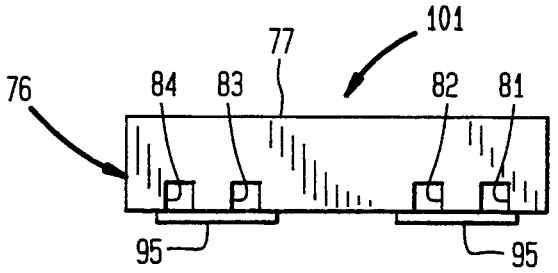
FIG. 13 is an end view of a support member shown in FIGS. 11 and 12.
Figure 14:
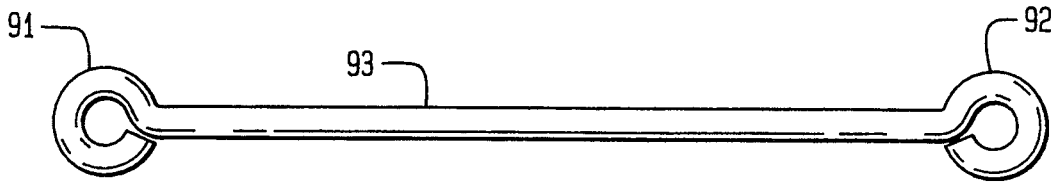
FIG. 14 is a detailed view of an attachment member shown in FIGS. 11 and 12.

Illustrated in FIGS. 11 and 12 is another footrest embodiment 74 having a modified support assembly 75 mounted on the frame 12 of the embodiment 11 shown in FIG. 1. The support assembly 75 is formed by a board 76 having a planar top surface 77 and a bottom surface 78 straddled between the upright members 18, 19 and struts 21, 22 of the frame 12. Formed in the bottom surface are a plurality of parallel spacing adjustment accommodating retainer grooves 81–84 extending between opposite edges 85, 86 of the board 76. The support assembly 75 is attached to the frame 12 by a pair of identical attachment members 88, 89, one of which is shown in detail in FIG. 14. Each attachment member 88, 89 has a pair of rings 91, 92 connected by an elongated rod 93.

As shown in FIGS. 11 and 12, the rod portion 93 of the attachment member 88 is rotatably retained by the groove 81 and the rod portion 93 of the attachment member 89 is rotatably retained by the groove 84. Retaining the rod portions 93 in the grooves 81, 84 are plates 95 secured to the bottom surface 78 of the board 76. The rings 91, 92 of the attachment member 88 are slidably received by the spaced apart struts 21, 22 of the frame 12 and the rings 91,92 of the attachment member 89 are slidably received by the spaced apart upright members 18, 19. A desired orientation for the planar surface 77 can be obtained by selectively tilting the board 76 on the frame 12 as illustrated by dashed lines in FIG. 12. During such orientation. adjustment of the board 76, the rings 91, 92 rotate into positions aligned with the upright members 18, 19 and struts 21, 22 so as to facilitate sliding motion thereon.

Figure 15:
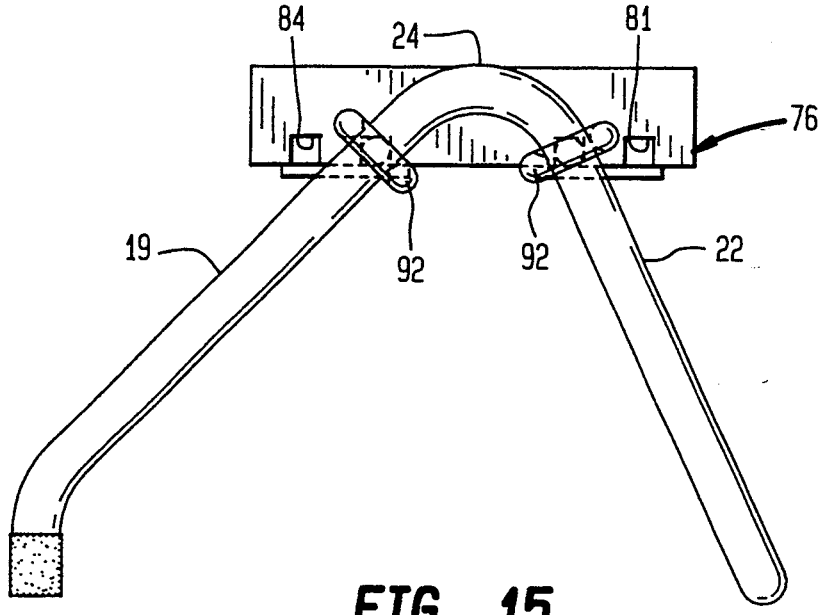
FIG. 15 is an end view similar to FIG. 12 but with a modified support assembly setting.

In the event that a more elevated position is desired for the top surface 77 of the board 76, the attachment assembly 88 is shifted from the groove 81 to the groove 82 and the attachment assembly 89 is shifted from the groove 84 to the groove 83 as shown in FIG. 15. Those adjustments reduce the spacing between the rings 93 along each of the opposite edges 85 and 86. Accordingly, the elevation of the board 76 on the frame 12 is increased as shown in FIG. 15. Shifting of the attachment members 88, 89 between the grooves 81–84 is accomplished by removal of the retainer plates 95 from the bottom surface 78 of the board 76.

Figure 16:
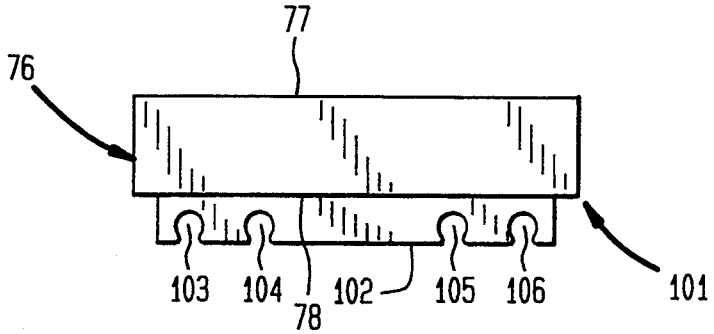
FIG. 16 is an end view of a modified support member.

FIG. 16 illustrates another support board embodiment 101 for use with the attachment members 88, 89. In the embodiment 101, the grooves 81–84 of embodiment 76 are replaced by a bracket 102 secured to the bottom surface 78 of the board 76 adjacent to each of its edges 85, 86. Each bracket 102 has a plurality of spaced apart spacing adjustment accommodating retainer sockets 103–106 for rotatably receiving an elongated rod portion 93 of an attachment member 88, 89.

Figure 17:
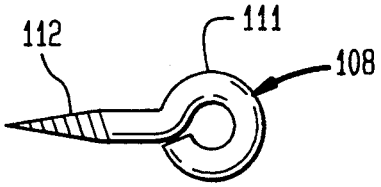
FIG. 17 is a detailed view of a modified attachment member.
Figure 18:
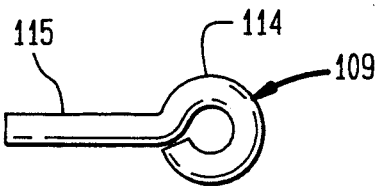
FIG. 18 is a detailed view of another modified attachment member.

FIGS. 17 and 18 illustrate, respectively, other attachment member embodiments 108, 109 for use with the support board 76 and the frame 12. The member 108 has a ring portion 111 and a connected threaded screw portion 112 while the member 109 has a ring portion 114 and connected stem portion 115. A pair of the members 108 can be screwed into each of the opposite edges 85, 86 at a spacing that provides a desired elevation of the board 76 on the frame 12. Similarly, a pair of the members 109 can be inserted rotatably into selected ones of the sockets 103–106 in the opposite edges 85, 86 to establish a desired board elevation.

Obviously, many modifications and variations of the present invention are possible in light of the above teachings. It is to be understood, therefore, that the invention can be practiced otherwise than as specifically described.

What is claimed is:

1. A footrest comprising:

frame means including a base portion for placement on a supporting surface, and a standard portion projecting upwardly from said base portion; said standard portion comprising a pair of substantially parallel horizontally spaced apart upright members, and a pair of substantially parallel horizontally spaced apart struts, each said strut having an upper end joined to an upper end of a different one of said upright members by a joining means, and said joined upright members and struts sloping upwardly toward each other;

support means defining a substantially planar support surface straddled between said joining means and having opposite edges disposed adjacent to said joined upright members and said struts; and attachment means projecting from said support means and attaching each of said opposite edges to said adjacent joined upright member and strut, each said attachment means including an upright attachment member slidably engaging said adjacent upright and a strut attachment member slidably engaging said adjacent strut and spaced from said upright attachment member, and including adjustment means between said attachment means and said support means and for adjusting said spacing between each pair of said spaced apart upright and strut attachment members whereby the vertical position of said support means on said standard portion can be adjusted.

2. A footrest according to claim 1 wherein each said upright attachment member is a ring projecting from said edge and slidably received by said upright member, and each said strut attachment member is a ring projecting from said edge and slidably received by said strut, and said adjustment means comprises retaining means for said rings and accommodating selective positioning thereof along said opposite edges.

3. A footrest according to claim 2 wherein each said ring has a stem portion rotationally received by said support means.

4. A footrest according to claim 3 wherein each said ring projecting from one of said edges is connected by an elongated rod to a ring projecting from an opposite said edge, and said support means defines at least two spaced apart elongated grooves for receiving each of said elongated members.

5. A footrest according to claim 3 wherein each of said rings can be secured by said retaining means in a selected position along said edge so as to permit adjustment of said spacing therebetween.

6. A footrest according to claim 2 wherein said retaining means comprises for each said ring a plurality of spaced apart recesses formed in each of said opposite edges.

7. A footrest according to claim 6 wherein each said ring includes a stem portion rotatably receivable by said recesses.

8. A footrest according to claim 2 wherein said retaining means comprises for each said ring a plurality of spaced apart grooves formed in each of said opposite edges.

9. A footrest according to claim 8 wherein said upright attachment rings are joined by a rod rotatably retainable in selected ones of said grooves, and said strut attachment rings are joined by a rod rotatably retainable in selected ones of said grooves.

* * * * *